US005184155A

United States Patent [19]

Yonekubo et al.

[11] Patent Number: 5,184,155

[45] Date of Patent: Feb. 2, 1993

[54] INK JET PRINT HEAD

[75] Inventors: Shuji Yonekubo; Tsuyoshi Kitahara; Tatsuo Furuta; Takahiro Katakura; Naomi Serizawa, all of Nagano, Japan

[73] Assignee: Seiko Epson Corporation, Tokyo, Japan

[21] Appl. No.: 611,620

[22] Filed: Nov. 9, 1990

[30] Foreign Application Priority Data

| | | | |
|---|---|---|---|
| Nov. 10, 1989 | [JP] | Japan | 1-292601 |
| Feb. 15, 1990 | [JP] | Japan | 2-34748 |
| Mar. 24, 1990 | [JP] | Japan | 2-74147 |

[51] Int. Cl.[5] ..... B41J 2/045

[52] U.S. Cl. ..... 346/140 R

[58] Field of Search ..... 346/140 R

[56] References Cited

U.S. PATENT DOCUMENTS

| | | | |
|---|---|---|---|
| 4,819,014 | 4/1989 | Yasuhara et al. | 346/140 R |
| 4,962,391 | 10/1990 | Kitahara et al. | 346/140 R |
| 4,998,120 | 3/1991 | Koto et al. | 346/140 R |

FOREIGN PATENT DOCUMENTS

| | | | |
|---|---|---|---|
| 0337429 | 12/1989 | European Pat. Off. . | |
| 3028404 | 7/1980 | Fed. Rep. of Germany . | |
| 0057250 | 3/1988 | Japan | 346/140 R |
| 1-257057 | 4/1988 | Japan . | |

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An ink jet print head in which a portion along which both piezoelectric conversion elements and a nozzle forming member are adhesively fixed is positioned at least a distance exceeding that of a stress concentration region toward a base portion of the piezoelectric conversion elements from a vibrating fulcrum of the piezoelectric conversion elements. As a result, any thermally induced stress concentration in the piezoelectric conversion elements is diffused over the adhesively fixed stress that acts backward of such stress concentration region. This prevents each piezoelectric conversion element from being deformed, thereby contributing to eliminating variations in the nozzle gap.

6 Claims, 3 Drawing Sheets

INK JET PRINT HEAD

BACKGROUND OF THE INVENTION

The present invention relates to an ink jet print head of a type in which piezoelectric conversion elements are selectively driven thereby to eject ink interposed between the piezoelectric conversion elements and a nozzle plate onto a recording medium from nozzles provided in correspondence to the piezoelectric conversion element in the form of ink droplets.

Japanese Patent Examined Publication No. 8953/1985 discloses ink jet printers of a type in which a plurality of piezoelectric conversion elements immersed in an ink droplet are selectively driven to pressurize and eject the ink droplet present in a nozzle gap formed between the conversion members and a nozzle plate to record an image on a recording medium. This type of printer, which requires neither an ink pressurizing chamber nor an ink flow path, not only allows the print head to be formed in a very small structure but also contributes to greatly reducing power consumption for printing by its efficient operation of ejecting the ink in the form of droplets, which is achieved by making the nozzle gap as small as possible. In addition, the use of a hot melt ink which can be converted into a liquid phase when heated permits the printing of images free from bleeding.

However, the print head used in this type of printer uses piezoelectric conversion elements, each composed of a lamination of a piezoelectric plate and a metal plate. These piezoelectric conversion elements are susceptible to temperature-dependent, bimetal-like deformation due to a difference between the linear expansion coefficients of their materials. For this reason, when the base of each piezoelectric conversion element is fixed on the nozzle plate by an adhesive that has been rendered molten by heating during the assembly process, each piezoelectric conversion element is deformed noticeably due to the accompanying heating, causing variations in nozzle gap between the nozzle plate and the conversion member even after cooling to ambient temperature. Since this nozzle gap affects the ink ejecting characteristics, the assembly process thus causes variations in nozzle gap among the individual piezoelectric conversion elements, which is of course a problem in this type of print head In addition, the piezoelectric conversion elements of even those printers using an ordinary liquid ink are likewise subjected to deformation at their normal operating temperature range between 0° and 40° C., thereby presenting the problem of impairing the quality of images recorded due to the temperature-dependent ink jetting characteristics.

SUMMARY OF THE INVENTION

The invention has been made in view of the above problems, and has as an object the provision of an ink jet print head capable of recording a satisfactory image by maintaining constant a nozzle gap between each piezoelectric conversion element and the nozzle forming member independently of temperature variations.

To achieve the above and other objects, the invention provides an ink jet print head in which a portion along which both piezoelectric conversion elements and a nozzle-forming member are adhesively fixed is positioned at least a distance exceeding that of a stress concentration region toward a base portion of the piezoelectric conversion elements from a vibrating fulcrum of the piezoelectric conversion elements. The stress concentration is caused when the piezoelectric conversion elements subjected to thermal stress.

As a result of this construction, even if a stress concentration arises in the piezoelectric conversion elements due to thermal stress acting thereupon at the time the piezoelectric conversation elements and the nozzle plate are assembled, such a stress concentration can be dispersed by an adhesively fixed stress acting in opposition thereto, thus suppressing the deformation of the piezoelectric conversion elements. Therefore, it is possible not only to eliminate variations in nozzle gap that influence ink jetting characteristics, but also to maintain stable printing quality due to the suppression within the smallest possible amount of the deflection of the piezoelectric conversion elements caused by temperature variations.

DESCRIPTION OF THE PREFERRED EMBODIMENTS

There are now follows a description of preferred embodiments of the invention shown in the accompanying drawings.

Figure 1:
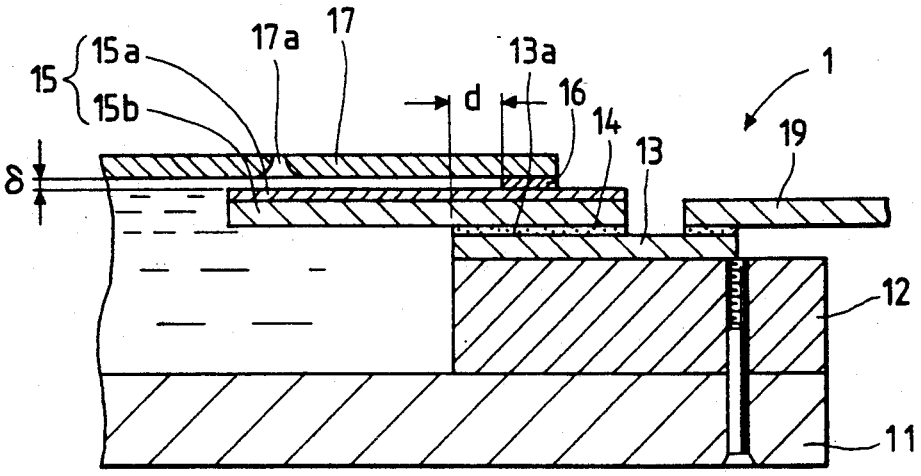
FIG. 1 is a diagram showing the construction of a basic ink jet print head of the invention.
Figure 2:
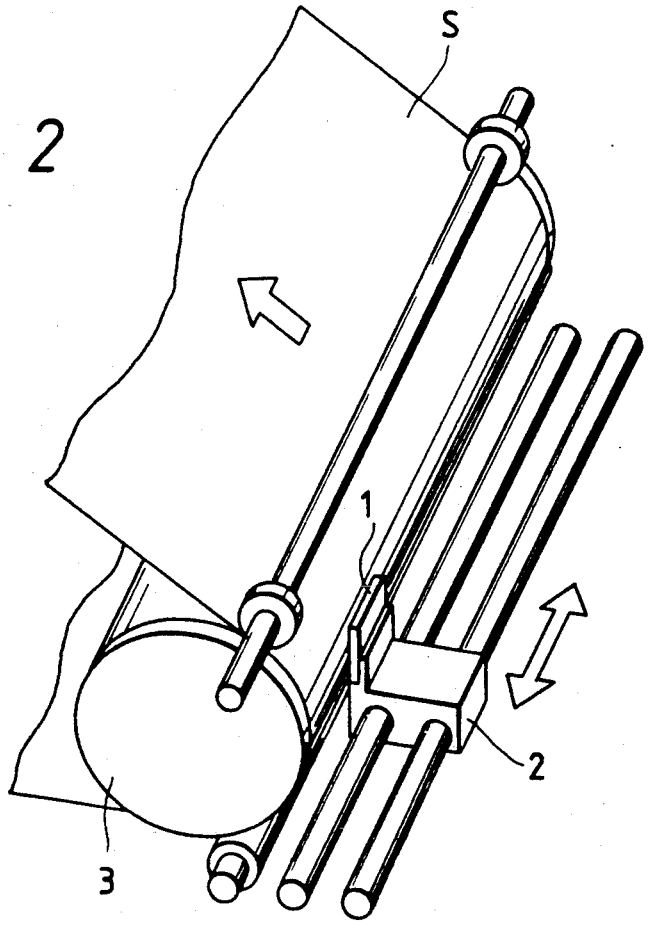
FIG. 2 is a diagram showing an exemplary ink jet printer having employing the ink jet print head of FIG. 1.

FIG. 1 shows a basic ink jet print head of the invention, and FIG. 2, an exemplary printer in which the print head of FIG. 1 is employed.

In these figures, an ink jet print head 1, which is a feature of the invention, is carried on a carriage 2 that axially shuttles along the circumferential surface of a platen 3 so that an image to be recorded is printed on a recording medium in accordance with recorded data.

This ink jet print head 1 includes a casing 11 containing ink therein, a base plate 12 fixed on an inner surface of the casing 11, a supporting body 13 serving both as an electric connection with a piezoelectric vibrating element 15 and as a fulcrum of the piezoelectric vibrating element 15, a plurality of piezoelectric vibrating elements 15 whose base portions are fixed on the supporting body 13 through a first adhesive 14, and a nozzle plate 17 which fixes the base portion of the piezoelectric vibrating elements 15 by clamping them between the supporting body 13 and itself. The nozzle plate 17, in particular, supports each piezoelectric vibrating element 15 by carrying part of its base portion which is positioned a distance d backward of the front end edge 13*a* of the supporting body 13 with an adhesive 16 serving to provide a nozzle gap δ, as will be described later.

Reference numeral 17*a* designates a nozzle on the nozzle plate 17 disposed so as to confront the free end of each piezoelectric vibrating element 15, and reference numeral 19 indicates a lead.

Each piezoelectric vibrating element 15 is cantilevered in that its base portion is supported by the front end edge 13*a* of the supporting body 13. Also, each piezoelectric vibrating element 15 has a laminated structure of a metal thin plate 15*a* and a piezoelectric ceramic member 15*b*, each having a different linear expansion coefficient. Thus, each piezoelectric vibrating element 15 is deformed in the manner of a cantilevered bimetal strip as its temperature varies.

Figure 3A:
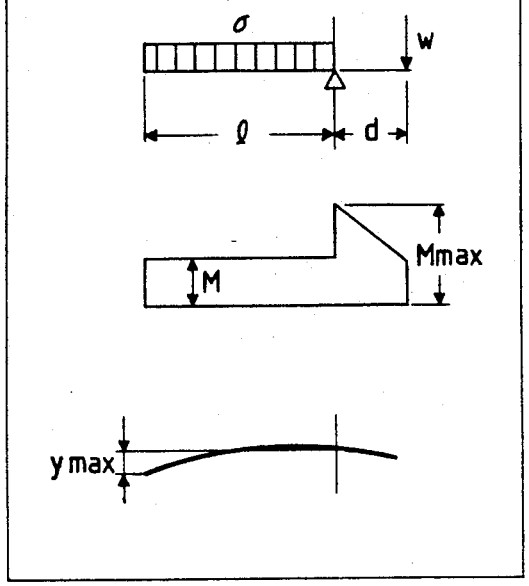
FIGS. 3(*a*) and 3(*b*) are diagrams for explaining the loads on the piezoelectric vibrating element, and moments and deflections acting thereupon, for a comparison between the ink jet print head of the invention and a conventional ink jet print head.
Figure 3B:
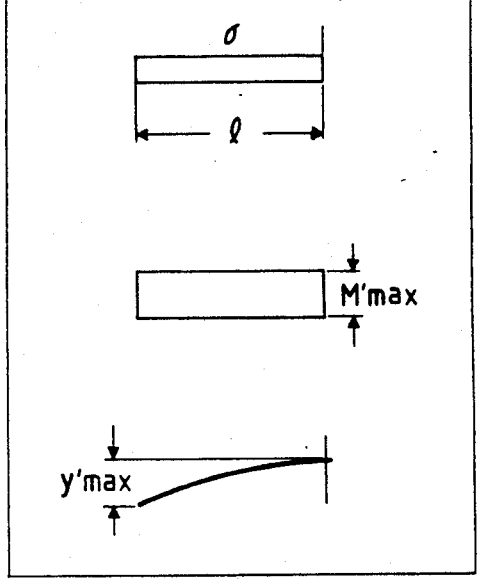

Such deformation can be assumed to be that of a cantilever in which a uniform stress σ, i.e., a uniform bending moment M, acts upon a portion between the fulcrum and the free end of the piezoelectric vibrating element 15. Therefore, for a simple cantilever having its base end supported as shown in FIG. 3(*b*), the maximum moment $M'_{max}$ and maximum deflection $Y'_{max}$ between the base end portion of the piezoelectric vibrating element and the vicinity thereof confronting the nozzle, i.e., the free end portion of the cantilever, are as follows:

$$M'_{max}=M \quad (1)$$

$$Y'_{max}=\frac{Ml^2}{2EI} \quad (2)$$

wherein E represents an elastic modulus of the cantilever, and I represents a geometrical moment of inertia of the cantilever.

However, as described previously, the piezoelectric element 15 is fixed by clamping by the nozzle plate 17 at a point the distance d backward of its fulcrum, so that an initial counterweight W acts thereupon. Thus, as shown in FIG. 3(*a*), a maximum moment $M_{max}$ which acts upon the fulcrum receiving the counterweight W is calculated as follows:

$$M_{max}=M+Wd \quad (3)$$

The second differential of the deflection curve of the cantilever by W is proportional to the bending moment. The inclination of the fulcrum, being proportional to the first integral of the bending moment, is expressed, using a coefficient K, as follows:

$$\frac{KWd^2}{2EI}$$

Hence, the maximum deflection at its free end is obtained as follows:

$$Y_{max}=\frac{Ml^2}{2EI}-\frac{KWd^2l}{2EI}$$

The model shown in FIG. 3(*a*) does not necessarily satisfy the condition for balancing the various forces acting thereon. This is because the model has been presented merely to explain that the effect of the initial counterweight W is dependent on the distance d, and thus for clarity, this simplified model has been presented. It should be noted that, in actual cases, the portion of the cantilever which is further back of the fulcrum is subjected to forces such as a deformation-dependent reaction force and a restrictive force accompanying the bending moment, and that these forces are neglected in the above description.

Therefore, between the piezoelectric vibrating element whose base portion is simply clamped and the piezoelectric vibrating element having an initial counterweight W acted upon a portion the distance d backward of its fulcrum, the difference in maximum deflection at their free ends when they are subjected to a thermal distortion is calculated as follows.

$$|Y_{max}-Y'_{max}|=\left|\frac{KWd^2l}{2EI}\right|$$

Thus, apart from the rigidity inherent in the material of the piezoelectric vibrating element 15, deflection of the free end of the piezoelectric vibrating element 15 can be reduced in proportion to the second power any further distancing its adhesively fixed point from the front end edge 13*a* of the supporting body 13.

This means that even if a different thermal distortion occurs in each of the piezoelectric vibrating elements 15 at the time the base portion of the piezoelectric vibrating element 15 is assembled onto the nozzle plate 17 by fixing the elements 15 with molten adhesive 16 heated to 250° C., such thermal distortion can be canceled by a biasing force acting upon the base portion, i.e., the initial counterweight W, and that a uniformly distanced gap can thus be formed for each piezoelectric vibrating element 15 when the assembly has been cooled to ambient temperature. It also means that the deformation of the piezoelectric vibrating element 15 can be substantially reduced to zero even with respect to a variation in room temperature of 40° C. or so in case of using liquid ink.

Figure 4:
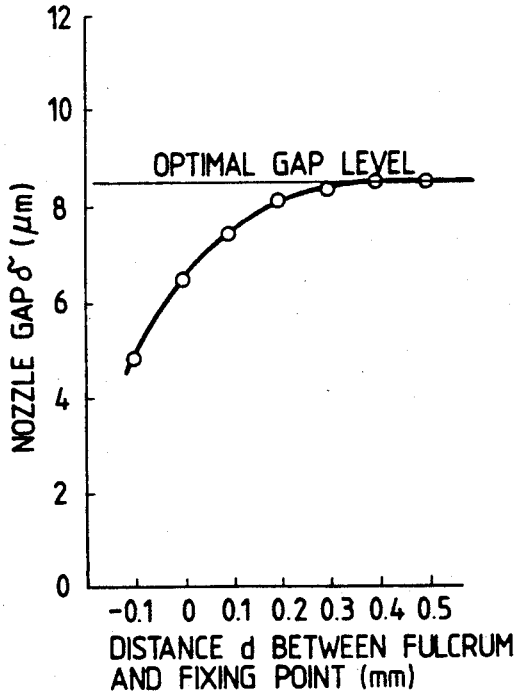
FIG. 4 is a diagram showing the relationship between the distance from the fulcrum and the adhesively fixed point and the gap formed between the piezoelectric vibrating element and the nozzle plate.

Experiments were conducted on a piezoelectric vibrating element 15 operated with a molten ink heated to 150° C. while raising the temperature by 100° C. The piezoelectric vibrating element was a lamination 2 mm in length composed of Invar having a linear expansion coefficient $2.0\times10^{-6}$ (1/K) and thickness of 50 μm, and a piezoelectric material having a linear expansion coefficient of $4\times10^{-6}$ (1/K) and a thickness of 100 μm. The base portion of the piezoelectric vibrating element was bonded to the nozzle plate by heating it to 250° C. As shown in FIG. 4, it was found that the larger the distance d from the front end edge 13*a* of the supporting body 13 to the adhesively fixed point of the piezoelectric vibrating element 15, the smaller the variation in nozzle gap δ becomes. It was also found that if the distance d is 0.5 mm or more, the influence of the distance d in case of temperature variations is substantially eliminated.

Figure 5:
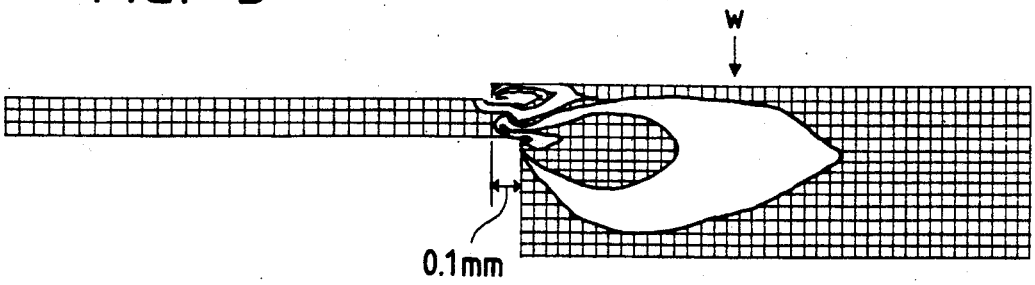
FIG. 5 is a diagram showing the internal stress caused in the piezoelectric vibrating element.

On the other hand, when subjected to a thermal stress, the piezoelectric vibrating element 15 suffers a large stress concentration at its fulcrum, i.e., the point abutted against the front end edge 13*a* of the supporting body 13. However, as is apparent from the simulation shown in FIG. 5, it was also verified that such a stress concentration acting on the piezoelectric vibrating element 15 can be dispersed by shifting the adhesively fixed point on the base portion rearward from the stress concentration region, thereby keeping the deformation of the piezoelectric vibrating element as small as possible.

Although the above description relates to a case in which each piezoelectric vibrating element 15 is deformed due to thermal distortion in a direction departing from the nozzle plate 17, there may be a case, depending on the linear expansion coefficients of the metal thin plate 15*a* and the piezoelectric ceramic member 15*b* and the lamination arrangement, in which each piezoelectric vibrating element 15 is deformed due to thermal distortion in a direction approaching the nozzle plate 17. However, even in such a case, the adhesion force of the adhesive 16, acting in the same manner as the counterweight W, contributes to elevating the base portion of the piezoelectric vibrating element 15. As a result, the same effect as above can be obtained.

Figure 6A:
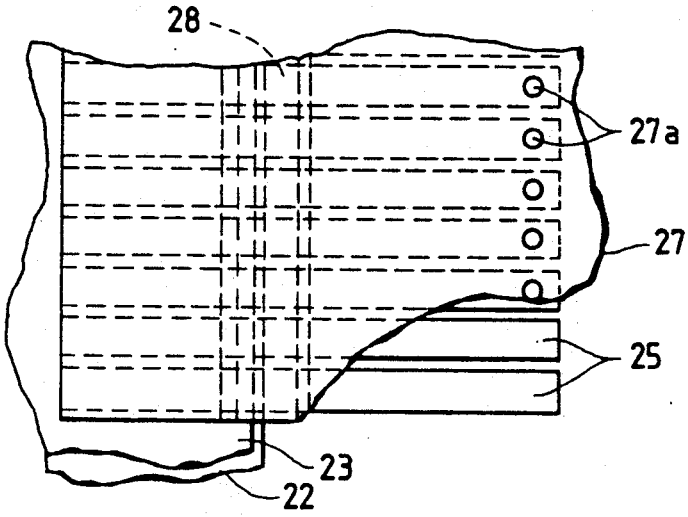
FIGS. 6(*a*) and 6(*b*) are a top view and a side view of an ink jet print head constructed in accordance with a preferred embodiment of the invention.
Figure 6B:
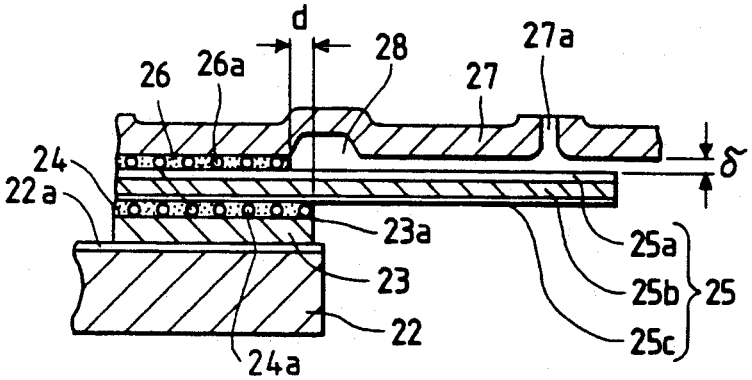

FIGS. 6(*a*) and 6(*b*), respectively, show a specific example of the invention having a construction based on the above theory.

In these figures, a base plate 22 made of stainless steel has an insulating layer 22*a* formed integrally thereon as a circuit board and which is made of a material such as a polyimide resin. A supporting body 23, serving both as a conductor for selectively making connection to each piezoelectric vibrating element 25 and as its fulcrum, is formed as an electroconductive circuit pattern accurately etched by photolithography on the insulating layer 22*a*. Particularly, the supporting body 23 is accurately constructed so that its front end edge 23*a* can function as a fulcrum of the piezoelectric vibrating element 25. Also, the supporting body 23 is made thick enough to protect the effective length of the piezoelectric vibrating element 25 from any run-off of excess adhesive 24. Thus, the thickness of the supporting body 23 is determined in consideration of the thickness of the adhesive 24 which is to be applied thereon. Thus, thicknesses at least in excess of the thickness of the adhesive 24 are required, as shown in Table 1.

TABLE 1

| Thickness of adhesive (μm) | Thickness of supporting body (μm) | Stability of fixed end |
|---|---|---|
| 20 | 5 | X |
| | 15 | Δ |
| | 40 | ○ |
| 30 | 5 | X |
| | 15 | X |
| | 40 | ○ |

○ - Very Stable
Δ - Poor in some cases
X - Unstable

The bar-like piezoelectric vibrating element 25, formed in multiplicity and fixed on the supporting body 23 through the adhesive 24 having electroconductive particles 24*a* mixed therein, is a three-layered member composed of a metal thin plate 25*a* made of an iron-Ni alloy, a piezoelectric member 25*b*, and a thin film 25*c* made of a metal such as gold, and is electrically connected to the supporting body 23 through the metal thin film 25*c* and the electroconductive particles 24*a*.

A nozzle plate 27, which is disposed on each piezoelectric vibrating element 25 with a predetermined nozzle gap δ provided through an adhesive 26 having gap forming particles 26*a* therein, has an array of nozzles 27*a* confronting the free ends of respective ones of the piezoelectric vibrating elements 25. On the inner surface of the base portion thereof, a single groove 28 is provided extending from a point the distance d backward of the front end edge 23*a* of the supporting body 23 parallel with the front end edge 23*a*. The flow of the adhesive 26 supplied from the base portion side of the piezoelectric vibrating element 25 is restrained by the groove 28 so that a counterweight can be formed on the base portion of the piezoelectric vibrating element 25, thereby to adhesively fix this base portion on the inner surface of the nozzle plate 27.

In this embodiment, it is ensured that each piezoelectric vibrating element 25 can vibrate properly with the accurately formed front end edge 23*a* of the supporting body 23 as a fulcrum. The vibrating element 25, free from any temperature-dependent influence, can also be fixed correctly on the supporting body 23 the distance d backward of the front end edge 23*a* by the adhesive 26 that has been positioned at the groove 28 of the nozzle plate 27 forming a meniscus therein.

Figure 7:
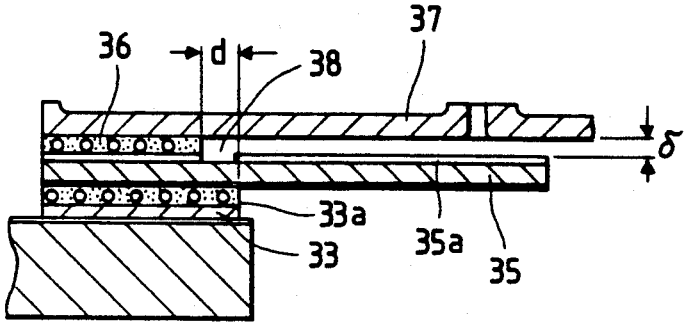
FIG. 7 is a side view showing another embodiment of the invention.

An embodiment shown in FIG. 7 involves another technique for positioning the front end edge of an adhesive 36 a distance d backward of the front end edge 33*a* of the supporting body 33.

That is, in the embodiment of FIG. 7 a thin metal plate 35*a* formed at an uppermost position of each piezoelectric vibrating element 35 is chipped from the base portion thereof, the chipped portion serving as a groove 38 for restraining the flow of the adhesive 36.

Accordingly, the flow of the adhesive 36, which is in a fluid state due to its being heated, is checked at a point the distance d backward of the front end edge 33*a* of the supporting body 33, thereby to correctly adhesively fix the piezoelectric vibrating element 35 on a portion defined by such a point below the nozzle plate 37.

As described above, according to the invention, the adhesively fixed portion between each piezoelectric conversion element and the nozzle forming member is positioned backwardly of the stress concentration region at the fulcrum portion of the piezoelectric conversion elements. Therefore, any thermally induced stress concentration in the piezoelectric conversion element will be diffused over the adhesively fixed stress that acts backward of such stress concentration region. This prevents each piezoelectric conversion element from being deformed, thereby contributing to eliminating variations in the nozzle gap, which has a strong effect upon the ink jetting characteristics.

In addition, as a result of this construction wherein the adhesively fixed stress acts upon the adhesively fixed portion which has been shifted backward of the vibrating fulcrum, temperature-dependent deflection of the piezoelectric conversion elements can be limited to the smallest possible amount, thus allowing stable printing quality to be maintained at all times.

Furthermore, the provision of the groove for positioning the adhesive either on the inner surface of the nozzle forming member or on the surface of the piezoelectric conversion elements confronting the nozzle forming member permits the adhesive in liquid state supplied from the tail end portion of the piezoelectric conversion elements to be correctly positioned a predetermined distance backward of the fulcrum, thereby preventing inconsistency in printing characteristics between print heads as well.

What is claimed is:

1. An ink jet print head comprising:

a supporting body, a plurality of piezoelectric conversion elements fixed to said supporting body at base ends thereof in a cantilevered manner such that an edge of said supporting body acts as a fulcrum of said piezoelectric conversion elements, a nozzle plate positioned over said piezoelectric conversion elements with a gap therebetween, and an adhesive for fixing said nozzle plate to said piezoelectric conversion elements at said base ends of said piezoelectric conversion elements, said adhesive terminating such that said gap extends inward of said fulcrum toward said base ends and said piezoelectric conversion elements by a distance;

wherein said distance at least exceeds a length of a region of stress concentration toward said base ends of said piezoelectric conversion elements from said fulcrum, said stress concentration being caused when said piezoelectric conversion elements are subjected to thermal stress; and wherein said distance is at least 0.5 mm.

2. The ink jet print head according to claim 1, further comprising a thin metal plate fixed to each of said piezoelectric conversion elements on free ends thereof and on a side thereof confronting said nozzle plate, said thin metal plate terminating at least said distance from said fulcrum.

3. The ink jet print head according to claim 1, further comprising: a base plate, an insulating layer formed on one side of said base plate, said supporting body being fixed to said insulating layer.

4. An ink jet print head comprising:

a supporting body, a plurality of piezoelectric conversion elements fixed to said supporting body at base ends thereof in a cantilevered manner such that an edge of said supporting body acts as a fulcrum of said piezoelectric conversion elements, a nozzle plate positioned over said piezoelectric conversion elements with a gap therebetween, and an adhesive for fixing said nozzle plate to said piezoelectric conversion elements at said base ends of said piezoelectric conversion elements, said adhesive terminating such that said gap extends inward of said fulcrum toward said base ends of said piezoelectric conversion elements by a distance;

wherein a groove for limiting a front end edge of said adhesive is formed in said nozzle plate at said distance backward of said vibrating fulcrum toward said base ends of said piezoelectric conversion elements, said groove extending parallel with said edge of said supporting body.

5. An ink jet print head comprising:

a supporting body, a plurality of piezoelectric conversion elements fixed to said supporting body at base ends thereof in a cantilevered manner such that an edge of said supporting body acts as a fulcrum of said piezoelectric conversion elements, a nozzle plate positioned over said piezoelectric conversion elements with a gap therebetween, an adhesive for fixing said nozzle plate to said piezoelectric conversion elements at said base ends of said piezoelectric conversion elements, said adhesive terminating such that said gap extends inward of said fulcrum toward said base ends of said piezoelectric conversion elements by a distance; and a layer of adhesive fixing said piezoelectric conversion elements to said supporting body, a thickness of said supporting body being greater than a thickness of said layer of adhesive.

6. An ink jet print head, comprising:

a supporting body, a plurality of piezoelectric conversion elements fixed to said supporting body at base ends thereof in a cantilevered manner such that an edge of said supporting body acts as a fulcrum of said piezoelectric conversion elements, a nozzle plate positioned over said piezoelectric conversion elements with a gap therebetween, and an adhesive for fixing said nozzle plate to said piezoelectric conversion elements at said base ends of said piezoelectric conversion elements, said adhesive terminating such that said gap extends inward of said fulcrum toward said base ends of said piezoelectric conversion elements by a distance;

wherein a groove for limiting a front end edge of said adhesive is formed in said piezoelectric conversion elements at said distance backward of said vibrating fulcrum toward said base ends of said piezoelectric conversion elements, said groove extending parallel with said edge of said supporting body.

* * * * *